United States Patent [19]

Balstad

[11] 4,181,227

[45] Jan. 1, 1980

[54] ROLLER SKATE BRAKING ASSEMBLY

[76] Inventor: Edward Balstad, Box 90, Cambridge, Wis. 53523

[21] Appl. No.: 930,671

[22] Filed: Aug. 3, 1978

[51] Int. Cl.[2] ..... A63C 17/14

[52] U.S. Cl. ..... 280/11.2

[58] Field of Search ..... 280/11.2, 11.21, 11.19, 280/11.28, 11.1 R, 11.1 BT, 7.13

[56] References Cited

U.S. PATENT DOCUMENTS

| | | | |
|---|---|---|---|
| 334,739 | 1/1886 | Blum | 280/11.2 |
| 899,963 | 9/1908 | Ferguson | 280/11.2 |
| 2,430,037 | 11/1947 | Vincent | 280/11.2 |
| 2,551,122 | 5/1951 | Hayner | 280/11.2 |
| 2,595,751 | 5/1952 | Balstad | 280/11.2 X |
| 2,920,899 | 1/1960 | Crone | 280/11.2 X |
| 3,250,544 | 5/1966 | Ware | 280/11.2 |
| 3,870,324 | 3/1975 | Balstad | 280/11.2 X |

FOREIGN PATENT DOCUMENTS

| | | | |
|---|---|---|---|
| 20811 | of 1909 | United Kingdom | 280/11.2 |

*Primary Examiner*—Joseph F. Peters, Jr.
*Assistant Examiner*—Milton L. Smith
*Attorney, Agent, or Firm*—Andrus, Sceales, Starke & Sawall

[57] ABSTRACT

A skate structure including a cylindrical braking member mounted on a transverse horizontal shaft. A radially extending bolt is countersunk into the shaft and extends upwardly through a slot in the toe of the skate's foot plate. A groove in the foot plate above the slot receives a nut and prevents the nut from turning during tightening of the bolt, which threadably passes through the nut. The braking member is firmly received in a downwardly and forwardly extending socket which communicates with the slot.

5 Claims, 4 Drawing Figures

ROLLER SKATE BRAKING ASSEMBLY

U.S. PRIOR ART OF INTEREST

Balstad—U.S. Pat. No. 2,595,751—Issued May 6, 1952
Crone—U.S. Pat. No. 2,920,899—Issued Jan. 12, 1960
Ware—U.S. Pat. No. 3,250,544—Issued May 10, 1966
Balstad—U.S. Pat. No. 3,870,324—Issued Mar. 11, 1975

BACKGROUND AND SUMMARY OF THE INVENTION

This invention relates to a roller skate construction and more particularly to a braking device at the toe of the skate to permit quick stops or abrupt and complicated turns.

The invention is primarily an improvement on my above-identified U.S. Pat. No. 3,870,324. In that patent, a cylindrical braking member is mounted to the toe end of the skate on a generally vertical axis. A bolt secures the braking member to the skate body. It has been found that in the structure of the said patent, the bolt tended to come loose and would also sometimes break due to the forces created during braking.

The present invention substantially eliminates the indicated problems and provides a more desirable roller skate brake construction.

In accordance with one aspect of the invention, a cylindrical braking member is mounted on a transverse horizontal shaft. A radially extending bolt is countersunk into the shaft and extends upwardly through a slot in the toe of the skate's foot plate. A groove in the foot plate above the slot receives a nut and prevents the nut from turning during tightening of the bolt, which threadably passes through the nut.

In accordance with another aspect of the invention, the braking member is firmly received in a downwardly and forwardly extending socket which communicates with the slot. During assembly, the bolt is positioned at the forward portion of the slot with the braking member slightly offset from the socket walls. Once the nut is started on the bolt, the latter is shifted in the slot to thereby seat the braking member in the socket. The assembly may then be finally tightened.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figures 1, 2, 3, 4:
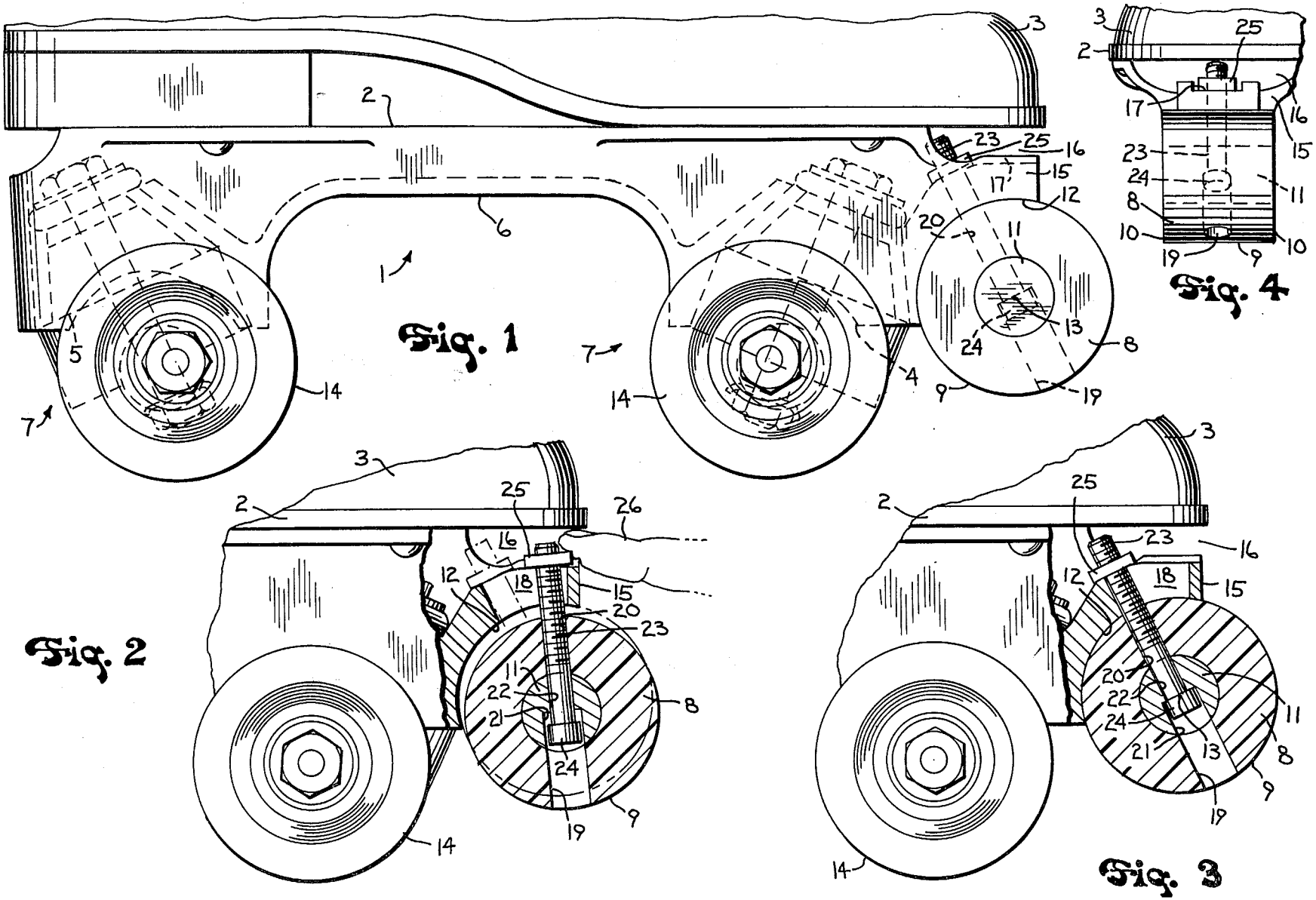
FIG. 1 is a side elevation of a roller skate having a braking assembly constructed in accordance with the invention.
FIG. 2 is a fragmentary side elevation of the braking device during initial mounting to the skate, with parts broken away and in section.
FIG. 3 is a view similar to FIG. 2 and showing the braking device in final mounted position.
FIG. 4 is a fragmentary front elevation of the skate.

As shown in the drawings, the invention is embodied in a roller skate 1 having the usual foot plate 2 to which a shoe 3 (shown fragmentarily) is attached in the usual manner. Plate 2 is provided with front and rear downwardly depending sockets 4 and 5 respectively, which are preferably joined at their bases by an arcuate reinforcing rib 6 extending along plate 2. Sockets 4 and 5 are adapted to receive fore and aft wheel mounting assemblies 7 which are described in detail in the present inventor's aforementioned U.S. Pat. No. 3,870,324.

For professional and other users, it is desired to provide a toe-mounted braking device to assist in stopping and otherwise controlling the skate.

As shown, the braking device comprises a cylindrical braking member 8 having a curved outer face 9 of 360° extent and a pair of spaced flat side walls 10. Member 8 may be of any suitable material, such as plastic, and is provided with a central shaft or axle 11 extending between walls 10.

Member 8 is adapted to be mounted to the toe of skate 1. For this purpose, foot plate 2, which may be plastic or metal, extends forwardly of front wheel-mounting socket 4 and is formed into an arcuate forwardly facing concave socket 12 having a center of radius 13 disposed above the centers of radius of the skate wheels 14. The upper portion of socket 12 is disposed in a wall 15 which extends forwardly beneath the toe of shoe 3 and which is spaced downwardly therefrom to form a gap 16. The upper surface of wall 15 which faces the gap is provided with a longitudinal groove 17 which is arcuately curved rearwardly and downwardly and is concentric with and coaxial with socket 12. An arcuate slot 18 extends downwardly through wall 15 and rearwardly from the front portion of the wall. Slot 18 is disposed generally centrally of groove 17 and provides communication between the groove and socket 12.

For purposes of mounting the braking device to the skate, braking member 8 is provided with a pair of diametrically opposed radial passages 19 and 20 with passage 19 being of larger diameter than passage 20. Passage 19 communicates with an enlarged counterbore 21 in axle 11, while passage 20 communicates with a passage 22 in the axle which extends outwardly from the floor of counterbore 21.

A bolt 23 is adapted to be inserted through these connecting passages, with the bolt head 24 passing through passage 19 and into counterbore 21, and the bolt shaft passing outwardly through passages 22 and 20. The outer bolt end extends outwardly beyond the periphery of braking member 8.

Referring to FIG. 2, when it is desired to mount braking member 8 to the skate, bolt 23 is first assembled to member 8 and axle 11 as described above. The composite structure is then moved to insert the outer end of bolt 23 upwardly through the forward end portion of slot 18, as shown in full lines. At this point, member 8 will not be seated in socket 12 but will be offset forwardly and downwardly therefrom. A rectangular nut 25 is then started on the end of bolt 23.

The reason for initially positioning bolt 23 and nut 25 at the forward end portion of groove 17 is because gap 16 is relatively narrow and a finger 26 could not penetrate deeply into the gap for assembling nut 25 to bolt 23. However, the initial front placement of the parts permits easy access to them by finger 26 so that the nut can be placed and started. Once this is accomplished, bolt 23 is shifted rearwardly in slot 18 which seats braking member 8 firmly in socket 12, as shown in phantom in FIG. 2. Nut 25 is positioned in gap 16 and groove 17.

Turning of bolt 23 as by a screwdriver, wrench or the like through access opening 19, then tightens and firmly connects the assembly together. The edges of groove 17 lock nut 25 against rotating during tightening.

The assembled structure, as shown in FIG. 3, provides a braking member 8 which is mounted on a transverse horizontal axis which coincides with center of radius 13 and which distributes braking load forces through the surface of socket 12 to foot plate 2. Member 8 seats firmly in socket 12 because both have the same radius and are coaxial.

The construction is such that a worn braking member 8 may be replaced without having to replace axle 11 or bolt 23.

Various modes of carrying out the invention are contemplated as being within the scope of the following claims particularly pointing out and distinctly claiming the subject matter which is regarded as the invention.

I claim:

1. A roller skate comprising:

(a) a foot plate, (b) fore and aft wheel mounting assemblies mounted to said foot plate, (c) said foot plate having a forwardly extending wall portion forming an arcuate socket on its under side and a longitudinal arcuate slot communicating between said socket and the top wall side, (d) a cylindrical braking member having the same radius as said socket and with said member seated in said socket and disposed on a transverse horizontal axis, (e) and connecting means extending through said slot and joining said braking member and said wall for securing said member in place in said socket.

2. The roller skate of claim 1 wherein said securing means comprises:

(a) a bolt extending through said braking member and said slot, (b) and a nut threadably mounted on said bolt and disposed on the said top side of said wall.

3. The roller skate of claim 2 which includes a groove disposed in said top wall side and concentric with said socket for locking said nut against rotation during tightening of said bolt.

4. The roller skate of claim 3 wherein said slot is centered in said groove.

5. The roller skate of claim 2, 3 or 4:

(a) which includes a shoe mounted on said foot plate, (b) said wall being spaced downwardly from said shoe to form a gap therebetween within which said nut is disposed, (c) said bolt, when loose, being shiftable between a forward position in said slot and a rearward position therein.

* * * * *